US006240856B1

(12) United States Patent
Paskey et al.

(10) Patent No.: US 6,240,856 B1
(45) Date of Patent: Jun. 5, 2001

(54) VEHICLE TOOL TRAY

(76) Inventors: Dennis J. Paskey, 3000 S. 105th St., Fort Smith, AR (US) 72903; D. James Booth, 3008 S. Gary St., Fort Smith, AR (US) 72901; Michael J. Booth, 3519 S. 96th St., Fort Smith, AR (US) 72903

( * ) Notice: Subject to any disclaimer, the term of this patent is extended or adjusted under 35 U.S.C. 154(b) by 0 days.

(21) Appl. No.: 09/468,817

(22) Filed: Dec. 22, 1999

Related U.S. Application Data

(60) Provisional application No. 60/113,812, filed on Dec. 23, 1998.

(51) Int. Cl.[7] ..... A47B 9/00

(52) U.S. Cl. ..... 108/146; 108/147.21; 248/129; 248/408

(58) Field of Search ..... 108/147.21, 147.19, 108/147, 146, 150, 49; 248/129, 407, 408, 412

(56) References Cited

U.S. PATENT DOCUMENTS

| | | | | |
|---|---|---|---|---|
| 1,829,281 | | 10/1931 | Henley . | |
| 3,393,649 | | 7/1968 | Miotke . | |
| 3,854,428 | * | 12/1974 | Fullenkamp | 108/146 |
| 4,072,209 | | 2/1978 | Bolis . | |
| 4,119,044 | | 10/1978 | Hines . | |
| 4,488,497 | | 12/1984 | Bevans . | |
| 4,509,649 | | 4/1985 | Evans . | |
| 4,601,246 | * | 7/1986 | Damico | 108/146 |
| 4,715,573 | | 12/1987 | Liegel . | |
| 4,728,065 | * | 3/1988 | Coote | 248/129 |
| 5,144,898 | * | 9/1992 | Posly | 108/49 X |
| 5,165,632 | | 11/1992 | Kuan . | |
| 5,181,681 | | 1/1993 | Edwards . | |
| 5,259,601 | * | 11/1993 | Vass . | |
| 5,374,019 | * | 12/1994 | Fischer . | |
| 5,460,392 | * | 10/1995 | Hansen . | |
| 5,473,997 | * | 12/1995 | Solomon et al. | 108/49 X |

* cited by examiner

*Primary Examiner*—Janet M. Wilkens
(74) *Attorney, Agent, or Firm*—Richard C. Litman

(57) ABSTRACT

The vehicle tool tray has a T-shaped based mounted on casters. A vertical post is mounted to the base at the junction of the shaft and crossbar of the Tee. The vertical post is composed of two telescoping sections which are preferably square and tubular in cross section. The telescoping sections are firmly clamped at the desired height by a lock mechanism having a cam and a crank lever pivotally attached to a U-shaped bracket, the cam releasably engaging one of a plurality of slots defined in the upper section of the vertical post. The upper telescoping section of the vertical post is also T-shaped. A pair of short angle irons extend horizontally from the ends of the crossbar of the upper section of the vertical post. The tray is supported on the angle irons and crossbar of the upper section in cantilever fashion. The tray includes a plurality of dividers sectionalizing the top surface of the tray into compartments adapted for holding tools or small parts. The tray includes a drawer mounted on slides on the bottom surface of the tray. The vehicle tool tray is particularly adapted for working on a vehicle with the hood open, the base being wheeled under the vehicle and the tray extending over the engine compartment in cantilever fashion.

8 Claims, 6 Drawing Sheets

VEHICLE TOOL TRAY

CROSS-REFERENCE TO RELATED APPLICATION

This application claims the benefit of U.S. Provisional Patent Application Serial No. 60/113,812, filed Dec. 23, 1998.

BACKGROUND OF THE INVENTION

1. Field of the Invention

The present invention relates to tool caddies, and particularly to a vehicle tool tray which may be wheeled to a position under the open hood of a vehicle for the convenience of a mechanic working on the vehicle.

2. Description of Related Art

The automobile mechanic is frequently required to open the hood of the vehicle and work on the engine. In the course of diagnosing engine problems or making repairs, he may have occasion to use a variety of tools and to remove small parts and fasteners. The task at hand may require that he set one or more tools aside in order to have one or both hands free for manipulation of various components under the hood. If the mechanic goes about his work in orderly fashion, he would normally have to make repeated trips back and forth to his tool box and the work bench, requiring repetitious walking and bending beneath the hood.

Frequently, the mechanic will resort to various improvisations and expedients to avoid such time consuming, tedious, and inconvenient tasks. Some mechanics will temporarily place their tools in pockets of their clothing, on top of the frame supporting the radiator, on the battery, on top of the air cleaner, or any other place under the hood within easy reach. Other mechanics will remove the air cleaner and place a towel over the throat of the carburetor to provide a platform on which they can place bolts, screws, and other small pieces.

The problem with such expedients is that invariably the tools have a tendency to become jostled and fall through the engine compartment onto the ground beneath the vehicle, or the mechanic will forget where he placed the tool. Small parts and fasteners have an annoying proclivity for falling on the engine into locations where they are difficult to see or locate. Further, some small parts need to be taken out in a particular order and replaced to their exact location, and they invariably become indistinguishably intermixed with such makeshift expedients. There is therefore a need for a vehicle tool tray providing the mechanic with a tool tray at hand under the hood on which he may place his tools. It is also desirable that such a tray have compartments for holding fasteners and small parts.

Various tool holders, caddies and tables have been proposed which alleviate these problems or which have certain features bearing some similarity to the claimed invention. U.S. Pat. No. 1,829,281, issued Oct. 27, 1931 to D. B. Henley, describes a stand for fruit packers having a rectangular base with four vertical telescoping legs supported on casters, a pivoting platform on which boxes are placed, and a tray for wrapping paper mounted above the platform. U.S. Pat. No. 3,393,649, issued Jul. 23, 1968 to N. Miotke, shows a reading stand and utility table having a T-shaped pedestal mounted on wheels, with a vertical swivel tube, the height being adjustable by operating a knurled screw head transverse to the vertical tube which causes a screw jack mechanism to raise and lower a sleeve supporting a platform which tilts. An auxiliary leg may be mounted under the free end of the platform for use as a table.

U.S. Pat. No. 4,072,209, issued Feb. 7, 1978 to G. W. Bolis, teaches a tubular stand to support a mechanic's body as he bends over the engine compartment. U.S. Pat. No. 4,119,044, issued Oct. 10, 1978 to R. E. Hines, shows a rectangular platform mounted on wheels with a vertical post extending up from the platform, a sleeve having a ledge on which a tray hangs, the sleeve being slidable on the post, and an S-shaped latched which is spring biased to-extend the lower part of the S through aligned holes in the post and sleeve.

U.S. Pat. No. 4,488,497, issued Dec. 18, 1984 to W. J. Bevans, teaches a mechanic's tool tray having a U-shaped base on caster wheels, a vertical supported post with braces welded to the corners of the U, a sleeve slidable on the post temporarily secured by inserting a rod through aligned holes in the post and sleeve, a U-shaped support member welded to the sleeve, and a heavy duty plastic tray attached to the support member by U.shaped straps, the tray having a magnetic strip and an electrical outlet. U.S. Pat. No. 4,509,649, issued Apr. 9, 1985 to R. J. Evans, describes a tool cart with a rectangular frame, a rectangular base, front and rear side walls supported by braces, the side walls having a plurality of columnar supports with slots, and a plurality of sheet metal trays with handles mounted between the side walls at different heights.

U.S. Pat. No. 4,715,573, issued Dec. 29, 1987 to R. D. Liegel, shows a convertible tool tray which may be used by a mechanic while working under a vehicle supported on a hydraulic lift, or on a creeper under a vehicle resting on the ground, which has a T-shaped base made from square tubes mounted on wheels, a vertical post made from telescoping square tubes secured by a set screw inserted through the outer tube to clamp the side wall of the inner tube, and a tray mounted on the vertical post by a socket depending from the tray, the tray having wheels so it can be used separately on the ground when detached from the post. U.S. Pat. No. 5,165,632, issued Nov. 24, 1992 to M. Kuen, discloses a tray for mounting on the opposite side of a post on a wheeled carriage from a rack used to lift an engine, the invention being a tray mount which keeps the tray level as the post bends when lifting an engine. The mount is U.shaped with a plate on the opposite side of the post from the U-shaped member, the tray being supported on a shaft having a 90° bend mounted on the plate, and kept level by two adjustment screws above and below a pivot tube mounted to the plate.

U.S. Pat. No. 5,181,681, issued Jan. 26, 1993 to J. W. Edwards, shows a tray for use by mechanics mounted on a post extending from a T-shaped base mounted on wheels, the height of the tray being adjustable by a crank operating a screw jack mechanism. The tray rotates horizontally and vertically and has a resilient magnetic pad for holding tools and parts. The device uses a square outer tube sleeve, a cylindrical inner tube sleeve having spherical depressions, and spheres disposed in the inside corners of the square outer sleeve extending into the spherical depressions on the inner sleeve.

None of the above inventions and patents taken either singly or in combination, is seen to describe the instant invention as claimed.

SUMMARY OF THE INVENTION

The vehicle tool tray has a T-shaped based mounted on casters. A vertical post is mounted to the base at the junction of the shaft and crossbar of the Tee. The vertical post is composed of two telescoping sections which are preferably square and tubular in cross section. The telescoping sections are firmly clamped at the desired height by a spring-biased lock mechanism having a locking cam. The upper telescoping section of the vertical post is also T-shaped. A pair of short angle irons extend horizontally from the ends of the crossbar of the upper section of the vertical post. The tray is supported on the angle irons and crossbar of the upper section in cantilever fashion. The tray includes a plurality of dividers sectionalizing the top surface of the tray into compartments adapted for holding tools or small parts. The tray includes a drawer mounted on slides on the bottom surface of the tray. The vehicle tool tray is particularly adapted for working on a vehicle with the hood open, the base being wheeled under the vehicle and the tray extending over the engine compartment in cantilever fashion.

Accordingly, it is a principal object of the invention to provide a vehicle tool tray having a base mounted on wheels and a tray extending in cantilever fashion from a vertical post, the tool tray being adapted for extending over the engine compartment of a vehicle, providing a convenient place for a mechanic to temporarily place tools, fasteners and small car parts while working under the hood of the vehicle.

It is another object of the invention to provide a cantilevered tool tray adapted for extending over the engine compartment of a vehicle having a plurality of compartments adapted for receiving and organizing various fasteners and small components of the engine.

It is a further object of the invention to provide a cantilevered tool tray adapted for extending over the engine compartment of a vehicle which is also equipped with a drawer for tool storage slidably attached to the bottom surface of the tool tray.

Still another object of the invention is to provide a cantilevered tool tray adapted for extending over the engine compartment of a vehicle in which the height of the tray is adjustable by means of a telescoping vertical post having a spring-biased lock mechanism with a locking cam for firmly locking the telescoping sections to provide sufficient support for the cantilevered tray.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
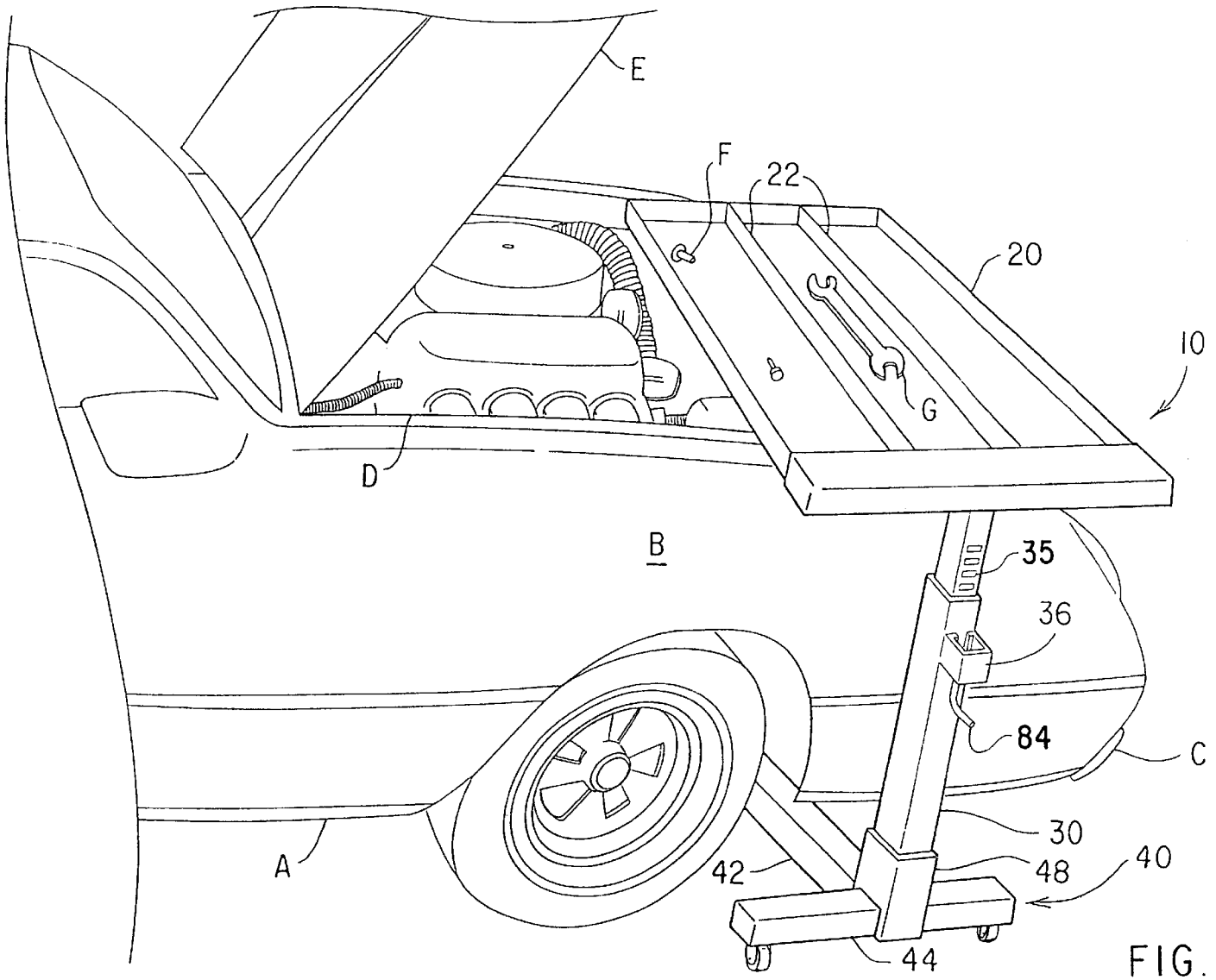
FIG. 1 is an environmental, perspective view of a vehicle tool tray according to the present invention.

The present invention is a vehicle tool tray, designated generally as 10 in FIGS. 1 through 5. As shown in FIG. 1, the vehicle tool tray 10 includes a tray 20 mounted in cantilever fashion on a vertical post 30 rising from a T-shape base 40. The construction of the device is designed to permit rolling the base 40 under the fender B or bumper C of a vehicle A so that the tray 20 extends over the engine compartment D of the vehicle A with the hood E raised. In a preferred embodiment, the tray 20 is divided into compartments by a plurality of divider walls 22 to provide a conveniently accessible platform for organizing and storing assorted fasteners F and tools G while working on the engine. Alternatively, the tray 20 need not be divided into compartments and may be furnished without divider walls 22, or the divider walls 22 may be removable to provide the user with the option of whether or not to divide the tray into compartments.

Figure 2:
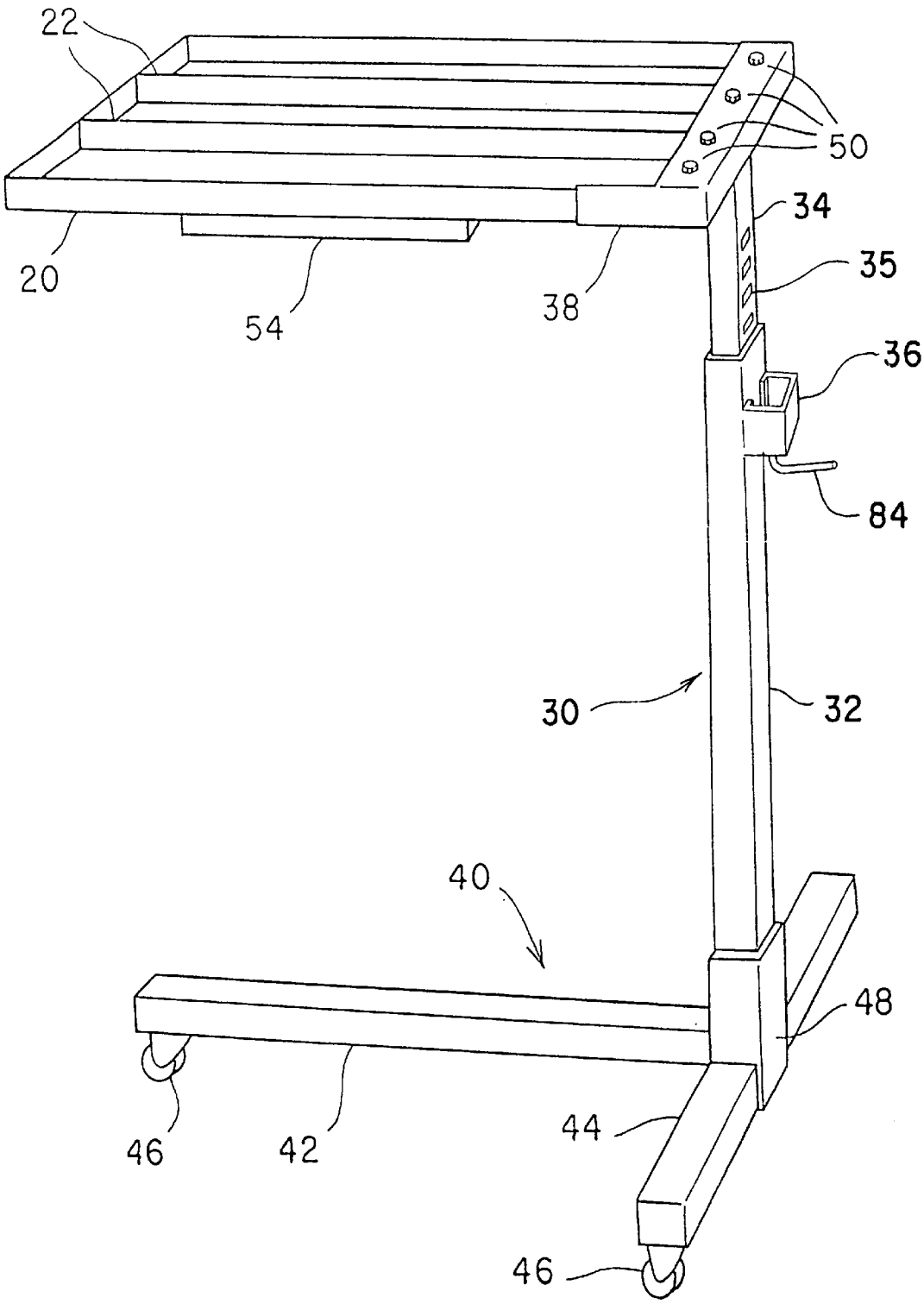
FIG. 2 is a front, perspective view of a vehicle tool tray according to the present invention.

The vehicle tool tray 10 is shown in more detail in FIG. 2. The vehicle tool tray 10 includes a T-shaped base 40, the shaft 42 and crossbar 44 of the base 40 preferably being made from ½" thick hollow steel tubing having a square shaped cross section. The dimensions of the square tubing might be two inches by two inches, the crossbar 44 being about eighteen inches long and the shaft 42 being about twenty-eight inches long. The ends of the crossbar 44 and shaft are mounted on conventional swivel casters 46 to provide the tool tray 10 with mobility. A stub pipe 48 is mounted vertically at the junction of the shaft 42 and the crossbar 44, the stub pipe 48 also being made from hollow square tubing.

A telescoping vertical post 30 is mounted on the base. The vertical post 30 includes a lower section 32 and an upper section 34. Preferably, both the lower section 32 and the upper section 34 are made from hollow steel tubing having a square shaped cross section. The outside perimeter of the lower section 32 is slightly smaller than the inside perimeter of the stub pipe 48 so that the lower section 32 may be inserted in the stub pipe 48 and fixedly attached, as by welding. The upper section 34 of the vertical post 30 is T-shaped, as seen most clearly in FIG. 3. The shaft 34*a* of the upper section has an outside perimeter slightly smaller than the inside perimeter of the lower section 32 of the vertical post 30 so that the upper section 34 is slidable in the lower section 32. Alternatively, the shaft 34*a* of the upper section 34 may be made of a U-shaped channel. The height of the vertical post 30 may be temporarily fixed by operation of a lock mechanism 36 further described below.

The crossbar 34*b* of the upper section 34 is mounted parallel to the crossbar 44 of the base 40. A pair of angle irons 38 are fixedly attached to the ends of the crossbar 34*b*, as by welding. The angle irons 38 project from the crossbar 34*b* in a horizontal plane in the same direction as the shaft 42 of the base 40 in order to support the edges of the tray 20. In the preferred embodiment, the lower section 32 of the vertical post 30 is two inch by two inch square steel tubing, about 3/16" thick and thirty inches long. The upper section 34 of the vertical post 30 is preferably made from 1½" square steel tubing about ⅛" thick, the shaft 34*a* being about thirty-one inches long and the crossbar 34*b* being about eighteen inches long.

Figure 3:
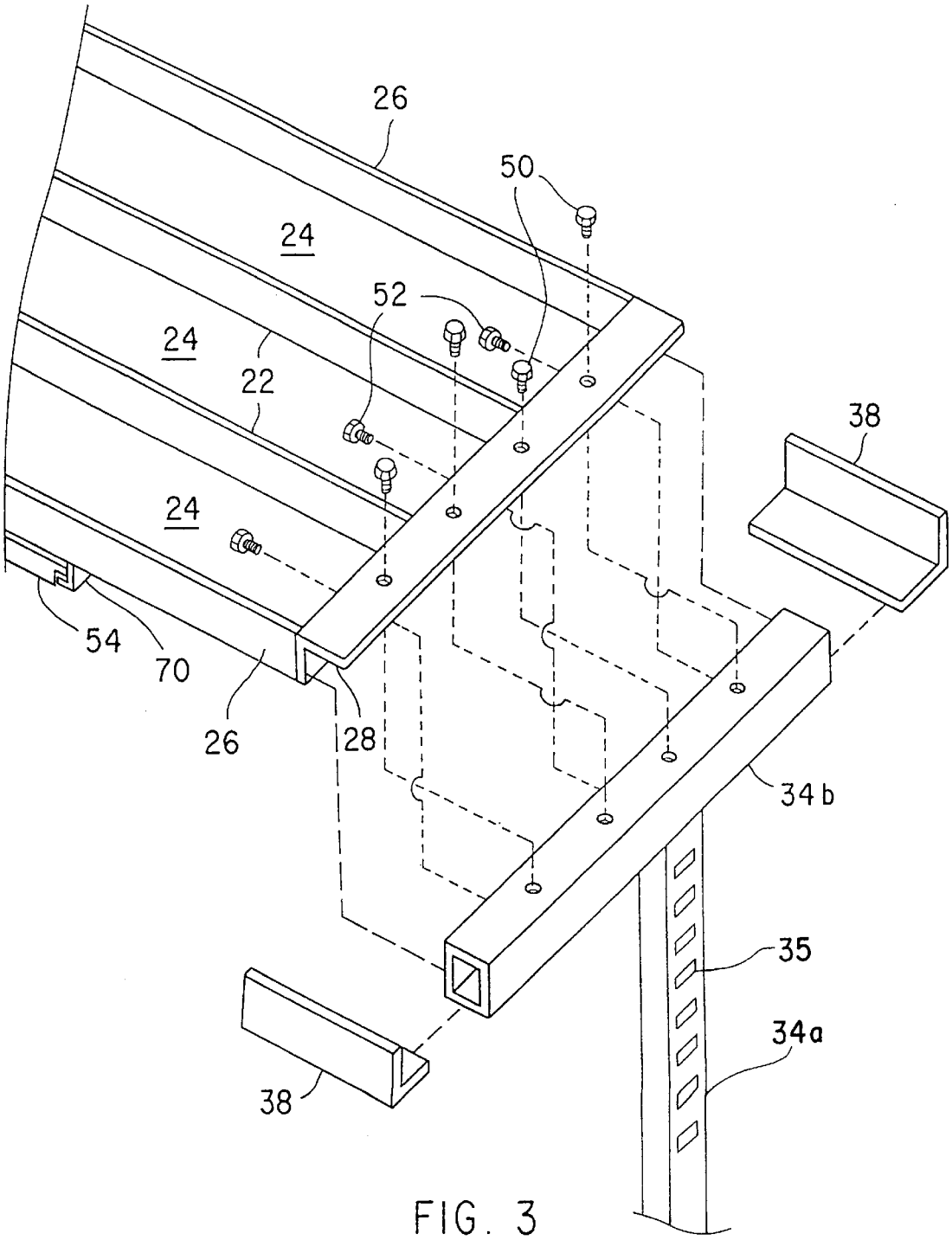
FIG. 3 is a fragmented, exploded view of the top section of the vehicle tool tray according to the present invention.

The tray 20 is mounted on the upper section 34*b* of the vertical post 30. As shown in FIGS. 2 and 3, the tray 20 includes a flat, rectangular, bottom sheet 24 having four vertical side walls 26 about its perimeter. The tray 20 also includes a flange 28 projecting from the top edge of one of the vertical side walls 26. The tray 20 is mounted on the upper section 34 of the vertical post 30 by means of a plurality of fasteners 50 extending through the flange 28 and into or through the top wall of the crossbar 34*b*, as well as a plurality of fasteners 52 extending through one of the vertical side walls 26 of the tray 20 and into or through a side wall of the crossbar 34*b*, the edges of the bottom sheet 24 being supported for part of their length adjacent the crossbar 34*b* by the pair of angle irons 38. The fasteners 50 and 52 may be self-tapping sheet metal screws, bolts, or other similar conventional fastening means. The tray 20, therefore, is attached to the vertical post 30 in cantilever fashion, being supported on three sides of the crossbar 34*b* by a combination of fasteners 50, 52 and the welded angle irons 38.

As described above, the tray 20 may be divided into compartments by a plurality of divider walls 22. It will be understood that although the divider walls 22 are shown extending longitudinally for the length of the rectangular bottom sheet 24, the divider walls 22 might optionally extend laterally across the width of the tray 20, or in a combination of longitudinal and lateral directions. It will also be understood that while only two divider walls 22 are shown, the tray may have more than two divider walls in order to create more compartments. The compartments provide a useful means for separating fasteners and other small components removed from the engine.

Figure 5:
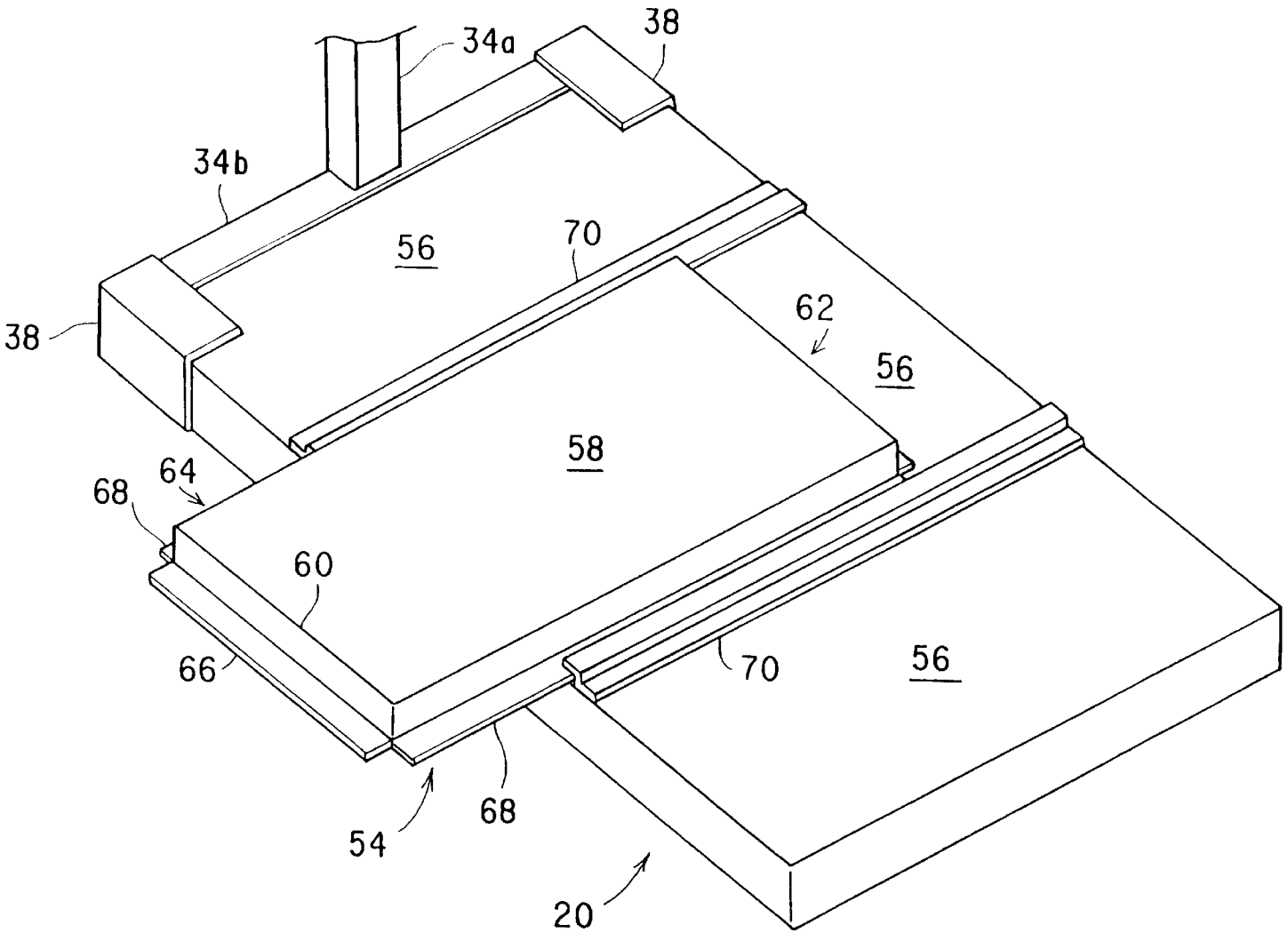
FIG. 5 is a bottom, perspective view of the vehicle tool tray according to the present invention showing a drawer under Lhe tray.

In the preferred embodiment, the tray 20 is made from eighteen gauge cold rolled steel, the bottom sheet 24 measuring about eighteen inches wide by thirty inches long, the vertical walls 26 measuring about 1½" high, and the top flange 28 being 1½" wide by eighteen inches long. A sliding drawer 54 is attached to the bottom surface 56 of the tray 20. As shown in FIG. 5, the drawer 54 includes a bottom surface 58, a front wall 60, a back wall 62, and a pair of side walls 64. In the embodiment shown, a portion of the front wall 60 is bent forwards to form a lip 66 which the user may employ as a drawer pull to slide the drawer 54 open and closed. Alternatively, the drawer 54 may have a notch defined therein so that a finger may be inserted through the notch in order to pull out the drawer 54. A pair of flanges 68 extend from the top edge of the side walls 64. A pair of L-shaped drawer guides 70 are fixedly attached to the bottom surface 56 of the tray 20. The drawer guides 70 may include stops (not shown) to limit the travel of the drawer 54. The drawer 54 provides a convenient storage compartment for frequently used tools, such as wrenches, screwdrivers, etc. In the preferred embodiment, the drawer 54 measures about sixteen inches by twenty inches and is about inch deep.

Figure 4A:
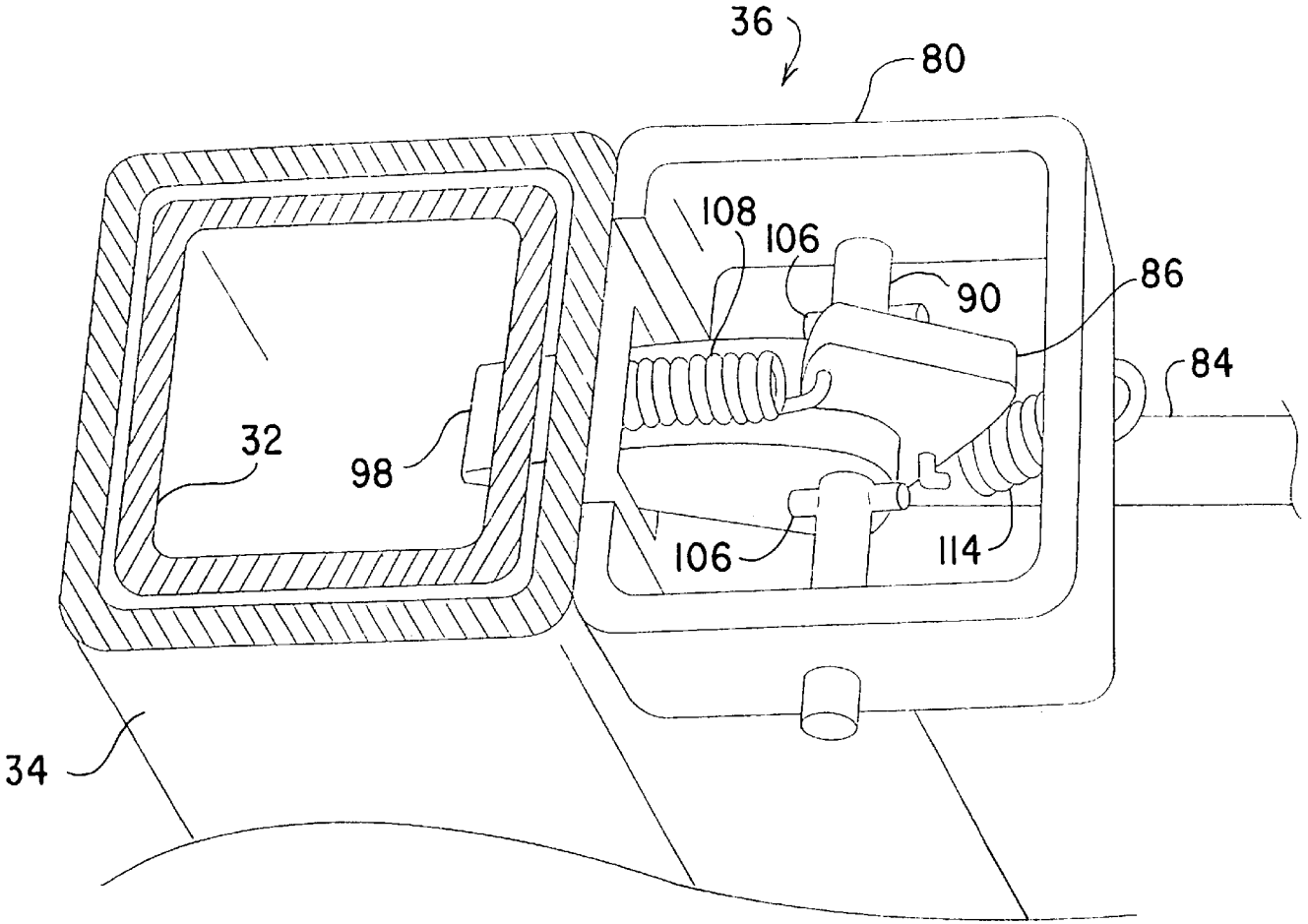
FIG. 4A is a top perspective view, partly in section, showing the lock mechanism of the vehicle tool tray according to the present invention.
Figure 4B:
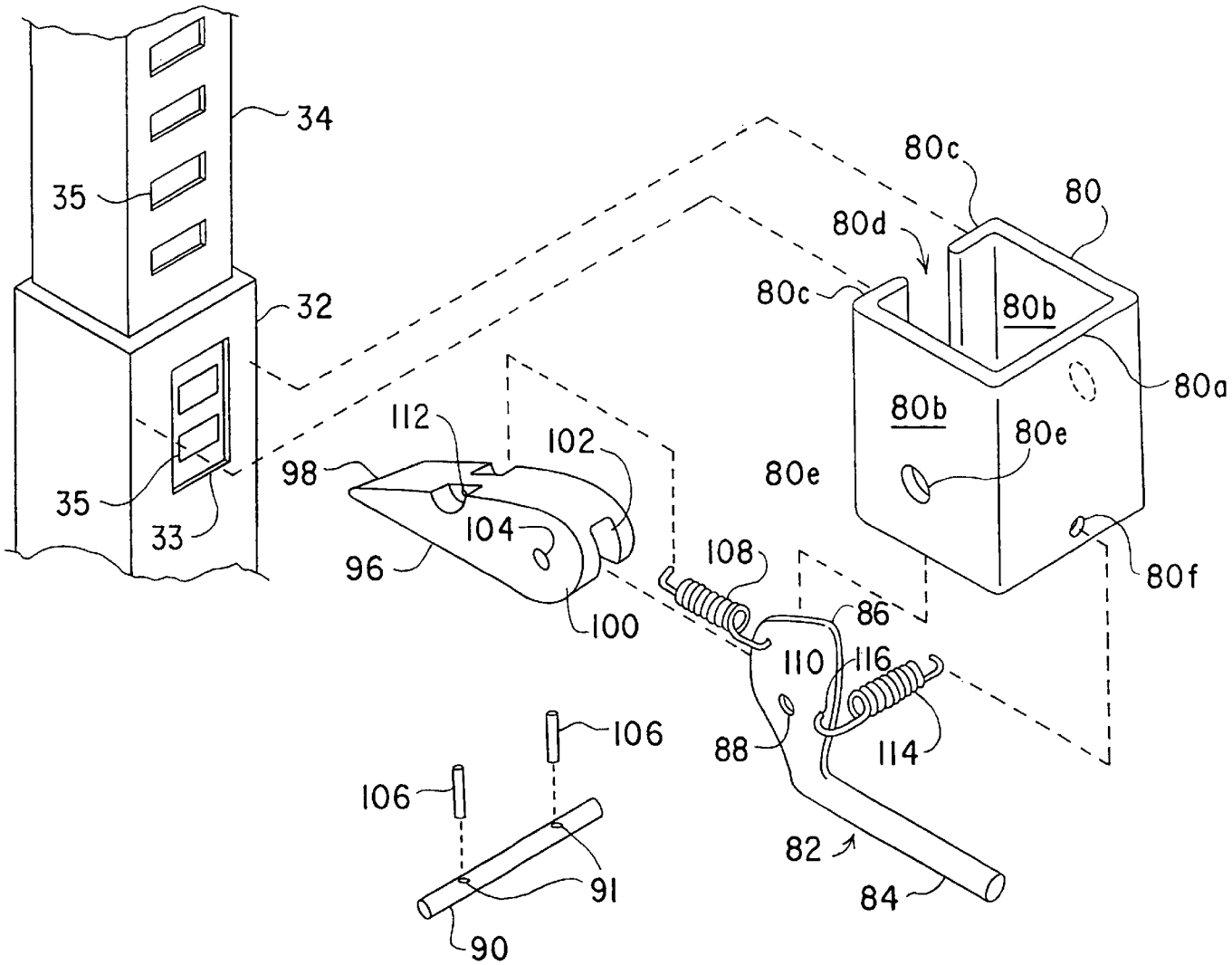
FIG. 4B is a fragmented, exploded, perspective view of the lock mechanism of the vehicle tool tray according to the present invention.

As shown in FIGS. 4A and 4B, the lock mechanism 36 is housed in a bracket 80 which is welded to the side walls of the lower section 32 of the vertical post 30. For purposes of illustration, the bracket 80 is shown as a generally U-shaped bracket having a web 80*a* and two side flanges 80*b*, the ends of the side flanges 80*b* being bent at 90 to parallel the web 80*a* and to define a pair of mounting flanges 80*c* spaced apart by a slot 80*d*. The mounting flanges 80*c* are welded to the lower section 32 on opposite sides of an elongated rectangular opening 33 defined in the lower section 32, so that the slot 80*d* is aligned with the opening. The bracket 80 may also be made from square tubing with a rectangular opening having the same dimensions as the opening 33.

The mechanism 36 includes a crank lever 82 having a generally cylindrical handle 84 terminating in a flat lug 86 which extends from the handle 84 at substantially a 90° angle. The crank lever 82 is pivotally attached to the bracket 80 by means of a cylindrical pivot pin 90 which extends through aligned apertures 80*e* in the side flanges 80*b* and an aperture 88 in the lug 86, so that the lug 86 is pivotally disposed substantially within the bracket 80 with the handle 84 extending away from the vertical post 30, the lug 86 being inserted into the bracket 80 from below.

The lock mechanism 36 includes a substantially wedge shaped cam 96 having a tapered edge 98 formed by the intersection of the planes defined by the top and bottom surfaces of the cam 96, and a blunt edge 100 at the opposite end of the cam 96. The blunt edge 100 has a notch therein defining a yoke 102. A bore 104 is defined through the yoke 102 adjacent the blunt edge 100 and parallel to the tapered edge 98. The cam 96 is pivotally mounted on the pivot pin 90 by positioning the lug 86 in the yoke 102 and aligning the bore 104 with the aperture 88 and extending the pivot pin 90 through one side flange 80*b*, then through one fork of the yoke 102, the aperture 88 in the lug 86, the second fork of the yoke 102 and the opposite side flange 80*b*. The pivot pin 90 may be retained in the bracket 80 by peening opposite ends of the pin 90, or by placing spot welds at the ends of the pin 90. The cam 96 is maintained in a center position on the pivot pin 90 by inserting roll pins 106 through bores 91 defined transversely through pivot pin 90 on opposite sides of the yoke 102.

A cam bias spring 108 has a first end inserted in a first hole 110 defined in the lug 86 and a second end inserted through a hole 112 defined in the body of the cam 96. The cam bias spring 108 operates to pull the tapered edge 98 of the cam 96 upward. A handle bias spring 114 has a first end inserted in a second hole 116 defined in the lug 86 and a second end inserted in a hole 80*f* defined in the web 80*a* of the bracket 80. The handle bias spring 114 operates to pull the handle 84 upward.

In operation, the height of the vertical post 30 is locked by inserting the tapered edge 98 of the cam 96 through one of a plurality of horizontal slots 35 which are spaced apart and extend longitudinally in a wall of the upper section 34 of the vertical post 30. The lock mechanism 36 is released by pulling down the handle 84 and lifting the upper section 34 of the post 30 upward. Depressing the handle 84 stretches handle bias spring 110 and places it under tension. Depressing the handle 84 also causes lug 86 to rotate towards the web 80*a*, placing cam bias spring 108 under tension and exerting an upward pull on the tapered edge 98 of cam 96. The tapered edge 98 cannot clear the slot 35 by rotation of the crank lever 82 alone, however, but requires lifting the upper section 34 of the post 30.

After the tapered edge 98 of the cam 96 is clear of the slot 35, the upper section 34 may be raised or lowered to the desired height. The crank lever 82 may then be released. Handle bias spring 114 compresses, causing the handle 84 to move upward and lug 86 to rotate towards the post 30. The force exerted by the lug 86 on the blunt edge 100 of the cam 96, the force of gravity, and relaxation of the tension on cam bias spring 108 cause the tapered edge 98 of the cam 96 to rotate into the nearest slot 35 available in the upper section 34, thereby locking the height of the vertical post 30.

In the preferred embodiment, the bracket 80 is made from ⅛" thick steel, the web 80*a* and side flanges 80*b* each being two inches wide. The pivot pin 90 is preferably 2¼" long and ⅜" in diameter, and the roll pins 106 are about ⅛" in diameter. The crank lever 82 has a total length of about eight inches, with the handle portion 84 being about four to five inches in length and ⅜" in diameter, the lug 86 being ⅛" thick and about 1½" wide. The cam 96 is between about 1¼"

long and about ⅜" thick, the top and bottom surfaces forming an acute angle between about 25° and 45°.

It is to be understood that the present invention is not limited to the sole embodiments described above, but encompasses any and all embodiments within the scope of the following claims. It will also be understood that the dimensions recited in the foregoing description are provided for purposes of enabling the disclosure by example and not by way of limitation. The actual dimensions of the vehicle tool tray 10 may vary and still be within the scope of the invention as claimed.

We claim:

1. A vehicle tool tray for holding tools, fasteners and small parts, comprising:

a) a base, the base being T-shaped, having a shaft and a crossbar, the base being mounted on a plurality of casters;

b) a vertical post having an upper section and a lower section, the upper section having a plurality of spaced apart slots defined therein, the lower section being fixedly attached to said base, the lower section being a hollow tube and the upper section being T-shaped, having a shaft and a crossbar, the shaft of the upper section having an outside perimeter slightly smaller than the inside perimeter of the lower section so that the shaft of the upper section is slidably disposed in the lower section;

c) a lock mechanism for temporarily clamping the upper section and the lower section of said vertical post in fixed relation in order to prevent sliding movement of the upper section, the lock mechanism having:

i) a bracket fixedly attached to the lower section of said vertical post, the bracket having two side flanges extending normal to said vertical post and being joined by a web in order to define a U-shape, said vertical post having a rectangular opening defined therein disposed between the side flanges, the web having a hole defined therein;

ii) a crank lever having a cylindrical handle and a flat lug extending substantially normal to said cylindrical handle, the flat lug having an aperture, a first hole, and a second hole defined therein;

iii) a cam having wedge shaped body, a tapered edge and a blunt edge, the blunt edge having a notch defining a yoke, a bore being defined through the yoke, the body having a hole defined therein;

iv) a pivot pin extending through the side flanges of said bracket, the bore defined through said cam, and the aperture defined in the lug of said crank lever, the lug being inserted into said bracket from below and disposed in the yoke of said cam, the handle protecting away from said vertical post, said cam being centered on said pivot pin by a pair of roll pins extending transversely through said pivot pin;

v) a handle bias spring having a first end inserted in the second hole defined in the lug and a second end inserted in the hole defined in the web of said bracket, the spring biasing the handle upward; and vi) a cam bias spring having a first end inserted in the first hole defined in the lug and a second end inserted in the hole defined in the cam body; and vii) wherein the height of said vertical post is locked by inserting the tapered edge of said cam through one of said plurality of slots defined in the upper section of said vertical post, the height being adjusted by pulling the handle down while lifting said tray slightly, adjusting the height, and releasing the handle;

d) a tray mounted on the crossbar of the upper section of said vertical post, said tray extending from said vertical post in a horizontal plane parallel to and in the same direction as the shaft of said base, the tray having a bottom surface; and e) a sliding drawer mounted on the bottom surface of said tray.

2. The vehicle tool tray according to claim 1, said tray further comprising:

a) a flat bottom sheet, the bottom sheet being rectangular in shape;

b) four vertical walls disposed about the perimeter of said bottom sheet;

c) a flange attached to the top edge of one of said vertical walls, the flange being adapted for attachment to the crossbar of the upper section of said vertical post; and d) a plurality of vertical disposed divider walls attached to said bottom sheet, the divider walls defining a plurality of compartments in said tray.

3. The vehicle tool tray according to claim 1, wherein said base and the upper and lower sections of said vertical post are made from steel tubing, the tubing being square in cross section.

4. The vehicle tool tray according to claim 1, wherein said tray is made from cold rolled steel.

5. The vehicle tool tray according to claim 1, further comprising a pair of L-shaped drawer guides mounted on the bottom surface of said tray, said drawer further comprising a rectangular bottom surface having a front wall, a rear wall, and two side walls disposed around the bottom surface, each side wall having a flange adapted for slidably engaging said drawer guides.

6. The vehicle tool tray according to claim 1, wherein the upper section of said vertical post further comprises a pair of angle irons fixedly attached to opposite ends of the crossbar of the upper section, said angle irons extending from said crossbar in a horizontal plane parallel to and in the same direction as the shaft of said base, the angle irons being adapted for supporting the sides of said tray.

7. A vehicle tool tray for holding tools, fasteners and small parts, comprising:

a) a base, the base being T-shaped, having a shaft and a crossbar, the base being mounted on a plurality of casters;

b) a vertical post having an upper section and a lower section, the lower section being fixedly attached to said base, the lower section being a hollow tube and the upper section being T-shaped, having a shaft and a crossbar, the shaft of the upper section having an outside perimeter slightly smaller than the inside perimeter of the lower section so that the shaft of the upper section is slidably disposed in the lower section;

c) a lock mechanism for temporarily clamping the upper section and the lower section of said vertical post in fixed relation in order to prevent sliding movement of the upper section;

d) a tray mounted on the crossbar of the upper section of said vertical post, said tray extending from said vertical post in a horizontal plane parallel to and in the same direction as the shaft of said base, said tray having a bottom surface and further having:

i) a flat bottom sheet, the bottom sheet being rectangular in shape;

ii) four vertical walls disposed about the perimeter of said bottom sheet;

iii) a flange attached to the top edge of one of said vertical walls, the flange being adapted for attachment to the crossbar of the upper section of said vertical post; and iv) a plurality of vertically disposed divider walls attached to said bottom sheet, the divider walls defining a plurality of compartments in said tray; and e) a sliding drawer mounted on the bottom surface of said tray.

8. A vehicle tool tray for holding tools, fasteners and small parts, comprising:

a) a base, the base being T-shaped, having a shaft and a crossbar, the base being mounted on a plurality of casters;

b) a vertical post having an upper section and a lower section, the lower section being fixedly attached to said base, the lower section being a hollow tube and the upper section being T-shaped, having a shaft and a crossbar, the shaft of the upper section having an outside perimeter slightly smaller than the inside perimeter of the lower section so that the shaft of the upper section is slidably disposed in the lower section;

c) a lock mechanism for temporarily clamping the upper section and the lower section of said vertical post in fixed relation in order to prevent sliding movement of the upper section;

d) a tray mounted on the crossbar of the upper section of said vertical post, said tray extending from said vertical post in a horizontal plane parallel to and in the same direction as the shaft of said base, the tray having a bottom surface; and e) a sliding drawer mounted on the bottom surface of said tray;

f) wherein the upper section of said vertical post further comprises a pair of angle irons fixedly attached to opposite ends of the crossbar of the upper section, the angle irons extending from said crossbar in a horizontal plane parallel to and in the same direction as the shaft of said base, the angle irons being adapted for supporting the sides of said tray.

* * * * *